US005899172A

United States Patent [19]

Dallen et al.

[11] Patent Number: 5,899,172

[45] Date of Patent: May 4, 1999

[54] SEPARATED OVERFIRE AIR INJECTION FOR DUAL-CHAMBERED FURNACES

[75] Inventors: John V. Dallen, Granby, Conn.; Steven B. Fothergill, Ooltewaa, Tenn.

[73] Assignee: Combustion Engineering, Inc., Windsor, Conn.

[21] Appl. No.: 08/834,617

[22] Filed: Apr. 14, 1997

[51] Int. Cl.[6] ..... F23C 5/32; B09B 3/00

[52] U.S. Cl. ..... 122/4 D; 110/345; 110/347; 431/173; 431/174

[58] Field of Search ..... 110/345, 347, 110/261, 263, 264, 265; 122/4 D; 431/173, 174

[56] References Cited

U.S. PATENT DOCUMENTS

| | | | |
|---|---|---|---|
| 4,672,900 | 6/1987 | Santalla et al. | 110/264 |
| 4,715,301 | 12/1987 | Bianca et al. | 110/347 |
| 5,020,454 | 6/1991 | Hellewell et al. | 110/264 |
| 5,146,858 | 9/1992 | Tokuda et al. | 110/347 |
| 5,195,450 | 3/1993 | Marion | 110/347 |
| 5,315,939 | 5/1994 | Rini et al. | 110/347 |
| 5,343,820 | 9/1994 | Marion | 122/4 D |
| 5,429,060 | 7/1995 | Tokuda et al. | 110/263 |
| 5,441,000 | 8/1995 | Vatsky et al. | 110/265 |
| 5,488,916 | 2/1996 | Bozzuto | 110/347 |
| 5,626,085 | 5/1997 | Donais et al. | 110/263 |

*Primary Examiner*—Teresa J. Walberg
*Assistant Examiner*—Gregory A. Wilson
*Attorney, Agent, or Firm*—Arthur E. Fournier, Jr.

[57] ABSTRACT

A separated overfire air injection system particularly suited for use in a fossil fuel-fired steam generating power plant and more specifically to a sixpoint separated overfire air tangential firing system employed in such power plants, particularly those embodying dual-chambered furnaces. A method of operating such a fossil fuel-fired steam generating power plant equipped with the sixpoint separated overfire air injection system of the present invention is also disclosed. The separated overfire injection system in accordance with the present invention includes six SOFA windboxes strategically located about the perimeter of the dual-chambered furnace volume so as to be operative to inject separated overfire air into the furnace volume in such a manner as to engage a fireball symmetrically tangential to a circle. Furthermore, the separated overfire air injection system, when so employed, produces a mixing index that is substantially equivalent over the elevations in the furnace in which mixing of separated overfire with generated flue gases occurs, which is achieved through the use of four SOFA windboxes as done heretofore in the prior art or as in accordance with the teachings of the present invention with three SOFA windboxes per each chamber of the furnace volume.

23 Claims, 5 Drawing Sheets

SEPARATED OVERFIRE AIR INJECTION FOR DUAL-CHAMBERED FURNACES

BACKGROUND OF THE INVENTION

This invention relates to the use of tangential firing systems in fuel-fired steam generating power plants and more specifically to a sixpoint separated overfire air tangential firing system employed in power plants which utilize dual-chambered furnaces.

In general the tangential firing technique involves the introduction of combustible fuel and air into a furnace volume from multiple locations about the perimeter of the furnace volume in such a manner that the fuel and air are directed tangent to an imaginary circle which lies in a horizontal plane and is concentric with the furnace volume. The fireball that results from the combustion of the fuel and air thus rotates about the center of the imaginary circle. This type of firing has many advantages, among them being good mixing of the fuel and air, stable flame conditions and long residence time of the combustion gases in the furnace.

In recent years, due to very strict state and federal environmental regulations demanding that emissions be maintained at acceptable levels, greater emphasis has been placed upon minimizing air pollution generated from these power plants. To this extent, oxides of nitrogen, also known as $NO_X$, have beet implicated as one of the constituents that contribute to the generation of acid rain and smog.

Oxides of nitrogen are a byproduct of the combustion of hydrocarbon fuels, such as pulverized coal in air, and are found in two main forms. If the nitrogen originates from the air in which the combustion process occurs, the $NO_X$ is referred to as 'thermal $NO_X$.' Thermal $NO_X$ forms when very stable molecular nitrogen, $N_2$, is subjected to temperatures above about 2800° F. causing it to break down into elemental nitrogen, N, which can then combine with elemental or molecular oxygen to form NO or $NO_2$. The rate of formation of thermal $NO_X$ downstream of the flame front is extremely sensitive to local flame temperature and somewhat less so to the local mole concentration of oxygen. Thermal $NO_X$ concentration can be reduced by lowering the mole concentrations of $N_2$ and $O_2$, reducing the peak flame temperature and reducing the amount of time that $N_2$ is subjected to these temperatures.

If the nitrogen originates as organically bound nitrogen within the fuel, the $NO_X$ is referred to as 'fuel $NO_X$.' The nitrogen content of coal, for instance, is comparatively small and, although only a fraction is ultimately converted to $NO_X$, is the primary source of the total $NO_X$ emissions from a steam generating power plant. The formation rate of fuel $NO_X$ is strongly affected by the rate of mixing between the fuel and air stream in general, and by the local oxygen concentration in particular. The formation of fuel $NO_X$ is a multi-stage process. During initial coal particle heat up the coal is broken down into both volatile matter consisting of reactive cyanogens, oxycyanogens and amine species and char consisting of unburned carbon, hydrocarbons and ash. In an oxygen rich environment the volatile matter will convert largely to $NO_X$ and in a fuel-rich environment it can be reduced to $N_2$. The remaining fuel-bound nitrogen is released during combustion of the carbon based byproducts, i.e. char, of the combustion of the coal particles. For char combustion to approach completion, an oxygen rich process is required. As with the volatile released $NO_X$, the eventual fate of char released nitrogen is dependent upon the specific time, temperature and stoichiometric history.

The stoichiometric ratio, $\phi$, of a combustion process is defined here as the number of moles of oxygen supplied to combust a given quantity of fuel divided by the number of moles of oxygen theoretically necessary to combust the same quantity of fuel. Typically, the stoichiometric ratio in a fossil fuel-fired steam generating power plant is a quantity greater than or equal to one and can be expressed as a percentage in which case it is referred to as percent theoretical air, $\tau=\phi\times100$. A related term is excess air which is $(\phi-1)\times100$ or $\tau-100$.

From the preceding it should be apparent that by controlling the distribution and mass flow rate of air to the combustion process the stoichiometric ratio of the process can be controlled and thus also the formation of $NO_X$. One method of controlling the distribution and mass flow rate of air to the combustion process occurring within a tangentially fired furnace is through the use of staged combustion. In accordance with staged combustion typically there is defined a main burner zone within the furnace volume. Within the main burner zone fuel, is initially only partially combusted in a fuel-rich environment by withholding a portion of the total air necessary for complete combustion. Next that portion of air which has been withheld from the main burner zone, and which is sometimes referred to as overfire air (OFA), is introduced into the furnace volume above the main burner zone, frequently at multiple elevations. A typical configuration of overfire air is found in the utilization of one or two closely grouped compartments at a single, fixed elevation near the top of a plurality of vertically arrayed compartments housed within a common vertical plenum known as a windbox. This overfire air is generally referred to as close coupled overfire air (CCOFA). In addition, at a higher elevation, and separated from the main windbox, separated overfire air (SOFA) is introduced into the furnace volume from a similar group of compartments located in a SOFA windbox. The use of separated overfire air in a tangentially fired furnace can be seen, by way of exemplification and not limitation, in U.S. Pat. Nos. 5,020,454, 5,195,450, 5,315,939 and 5,343,820, each of which teaches the use of a plurality of separated overfire air compartments.

Upon introduction into the furnace volume above the main burner zone the separated overfire air is mixed with and finally combusted with the products generated by the incomplete combustion occurring within the main burner zone. The use of close coupled and separated overfire air minimizes $NO_X$ formations via two mechanisms. First, by having a fuel-rich atmosphere in the main burner zone, i.e., a so called substoichiometric condition, the initial amount of fuel $NO_X$ formed is reduced because less oxygen is available to combine with the fuel-bound nitrogen. Second, lower fuel $NO_X$ results because of the reduced air concentrations during the initial firing stage. Thus, this has the effect of increasing the residence time within the main burner zone. To this end, residence time is the amount of time necessary for a fuel particle to combust. The increased residence time provides an environment, which is conducive to the reduction of any oxidizable $N_2$ volatiles that have been formed such as $NH_3$ or HCN. This is because the $NO_X$ compounds and the volatiles are entrained and reduced to their elemental components, oxygen and nitrogen, and because the hydrocarbons are combusted. Furthermore, the use of overfire air has the effect of reducing the peak flame temperatures, thereby resulting in lower thermal $NO_X$ formation.

In accordance with a typical configuration of a tangentially fired furnace wherein both staged combustion and overfire air are being utilized, fuel plus primary air, as well as secondary air and close coupled overfire air, are supplied, by means of a forced draft fan and various ducts, to a main windbox. From the main windbox, in accordance with conventional practice, the fuel and air are then introduced into the furnace volume. Primary air is used to transport solid fuel to the windbox and secondary air and close coupled overfire air are used to control the stoichiometric ratio within the main burner zone. The flow rates of secondary air and close coupled overfire air are controlled by individual dampers located within the main windbox. Furthermore, in accordance with a typical configuration of a tangentially fired furnace, main windboxes may be located at or near the corners of the furnace volume with fuel and air directed tangential to an imaginary circle, which lies in a horizontal plane and is concentric with the furnace volume. However, tangential firing may also be accomplished with windboxes located at or near the mid-wall of the furnace sides. U.S. Pat. No. 5,429,060 discloses the use of burners disposed at the central portions of respective sides in a horizontal cross-section of a furnace wall and U.S. Pat. No. 5,315,939 discloses an integrated low $NO_X$ tangential firing system.

In many existing power plants a dual-chambered furnace volume is provided wherein the combustion process takes place. Typically tangential firing is accomplished in these power plants via four main windboxes per chamber suitably located at appropriate points along the front and rear waterwalls, which along with the side waterwalls serve to define the furnace volume. However, such furnaces may not be equipped with close coupled overfire air and/or separated overfire air. Instead, the main windboxes and associated ductwork may simply direct fuel along with primary air and secondary air into the respective chambers. In a dual-chambered furnace volume, the resulting combustion of the fuel and air injected thereto yields two rotating fireballs. Each of these two rotating fireballs is coaxial with the center of a corresponding one of the dual chambers of the furnace volume.

It should be readily apparent from the foregoing that in a tangentially fired furnace, it is desirable to reduce the formation of $NO_X$ during the combustion process itself. This is in fact a matter of critical importance and a major concern in the design and operation of new power plants as well as in the retrofitting of existing plants. Reducing the formation of $NO_X$ during the combustion process obviates the need for expensive post combustion air pollution devices. However, without overfire air and the attendant $NO_X$ reducing capabilities that it affords, it is difficult for power plants not so equipped to meet state and federal $NO_X$ emission requirements. Therefore, in order to meet these requirements, it is desirable to equip the furnaces of these power plants with separated overfire air (SOFA).

In a retrofit application there are, however, numerous difficulties that need to be overcome, before the furnaces of these power plants can, without sacrificing the aforementioned advantages of tangential firing (good mixing of fuel and air, stable flame conditions and long residence time of combustion gases in the furnace), be equipped with separated overfire air. First, it is necessary to maintain the total mass flow rate of air, which is to be introduced into the respective chambers of the multi-chambered furnace volume. This means that the totality of primary air, secondary air, and close coupled overfire air if present, before retrofit, is equal to the totality of primary air, secondary air, close coupled overfire air and the retrofitted separated overfire air. Furthermore, the totality of the mass flow rate of fuel introduced into the furnace volume must remain the same before and after the retrofitting of the separated overfire air. Maintaining the totality of the mass flow rates of air and fuel furthermore must be accomplished while the total mass flow rate of output steam produced by the power plant is also being maintained. In addition, it is also necessary that the management of the fireball remains consistent before and after the retrofitting. By the management of the fireball is meant the ability to maintain the stability of the fireball as well as its shape and location within the respective chambers of the multi-chambered furnace volume. Still further it is necessary to minimize the number of expensive penetrations that are required to be made through the waterwalls of the furnace volume in order to retrofit the separated overfire air. Moreover, it is desirable to do so because of the limited space that is available to accommodate added ductwork. In view of the need to minimize the number of waterwall penetrations, it is also desirable to accomplish the retrofitting of the separated overfire air with a minimum number of SOFA windboxes.

The present invention is capable of addressing these needs while maintaining the low $NO_X$ advantages of tangentially fired staged combustion. This is achieved by providing six SOFA windboxes strategically located about the perimeter of each chamber of a dual-chambered furnace volume at an elevation above the main burner zone and oriented so as to inject separated overfire air into each chamber in such a manner that the mixing of the separated overfire air with the flue gases generated therein is substantially equivalent whether three SOFA windboxes are used or four SOFA windboxes are used.

As alluded to above, it is essential for purposes of achieving efficient combustion that there be as thorough and complete a mixing of fuel and air as possible. To that end, it has been found that, in accordance with the present invention, separated overfire air delivered to the respective chambers of a dual-chambered furnace volume by means of three strategically spaced SOFA windboxes per chamber results in a mixing of separated overfire air and the combustion gases in the furnace volume that is virtually identical to the mixing which is achieved through the utilization of more than three SOFA windboxes per chamber, e.g., four SOFA windboxes per chamber. Furthermore, in the present invention, flame stability, shape and location within the chamber are not degraded when three SOFA windboxes are used as opposed to the use of more than three SOFA windboxes, e.g., four SOFA windboxes. Also in the present invention, a furnace volume retrofitted with three SOFA windboxes will still enable that there be the long residence time of the combustion gases in the furnace volume which is inherent with the employment of the overfire air concept to be realized. Also in accordance with the present invention it is still possible to maintain the totality of the mass flow rates of fuel and air delivered to the furnace volume while yet maintaining the totality of the mass flow rate of output steam of the power plant when the subject matter of the present invention is employed in a retrofit application. Furthermore, in accordance with the present invention a minimum number of expensive waterwall penetrations and attendant ductwork associated with SOFA windboxes are required. Still further, the subject matter of the present invention, although primarily intended for application in dual-chambered furnace volumes, is equally applicable to both dual-chambered and single-chambered furnace volumes.

It is, therefore, an object of the present invention to provide a new and improved separated overfire air system which is particularly suited for use in a dual-chambered furnace volume.

It is also an object of the present invention to provide such a new and improved separated overfire air system for use in a dual-chambered furnace volume, which is characterized in that through the use thereof the mass flow rate of fuel and the mass flow rate of air delivered to the respective chambers of the dual-chambered furnace volume remains unchanged after being retrofitted therein.

It is a further object of the present invention to provide such a new and improved separated overfire air system for use in a dual-chambered furnace volume, which is characterized in that through the use thereof the mass flow rate of output steam remains unchanged after being retrofitted therein.

It is still a further object of the present invention to provide such a new and improved separated overfire air system for use in a dual-chambered furnace volume, which is characterized in that through the use thereof the ability to maintain fireball stability, shape and position within the respective chambers of the dual-chambered furnace volume is unaffected when retrofitted therein.

It is yet a further object of the present invention to provide such a new and improved separated overfire air system for use in a dual-chambered furnace volume which is characterized in that the use thereof necessitates only a minimum number of waterwall penetrations and attendant ductwork for purposes of effecting the retrofit thereof therein.

It is also an object of the present invention to provide such a new and improved separated overfire air system for use in a dual-chambered furnace volume, which is characterized in that through the use thereof it is possible therewith to effect a reduction in the formation of $NO_X$ in the combustion process occurring within the respective chambers of the dual-chambered furnace volume.

It is still further an object of the present invention to provide such a new and improved separated overfire air system for use in a dual-chambered furnace volume which is characterized in that through the use thereof it is possible to achieve mixing of separated overfire air with combustion gases in the furnace volume which is very nearly equivalent from the use of three SOFA windboxes to that attainable with more than three SOFA windboxes, e.g., four SOFA windboxes.

It is another object of the present invention to provide such a new and improved separated overfire air system for use in a dual-chambered furnace volume which is characterized in that it is equally well suited for use either in retrofit applications or in new applications.

It is yet another object of the present invention to provide such a new and improved separated overfire air system, which is characterized in that it is employable in both dual-chambered as well as single-chambered furnace volumes.

It is still further an object of the present invention to provide such a new and improved separated overfire air system for use in a dual-chambered furnace volume, which is characterized in that it is relatively easy to install, relatively simple to operate, yet is relatively inexpensive to provide.

SUMMARY OF THE INVENTION

In accordance with one aspect of the present invention there is provided a system for introducing separated overfire air (SOFA) into a dual-chambered furnace volume. The invention is characterized in that the separated overfire air is introduced into each chamber of the dual-chambered furnace volume from three SOFA windboxes strategically located about the perimeter of each of the respective chambers. These SOFA windboxes are further so located as to be above, and in offset relation with, the main windboxes of the respective chambers of the furnace volume. Thus, in accordance with the best mode of the present invention there are three SOFA windboxes per chamber resulting in a sixpoint separated overfire air injection system. The invention is further characterized in that the separated overfire air is directed into the respective chambers of the furnace volume along predetermined directions so as to collectively engage, in a co-rotational or counter-rotational fashion, the fireball that is centered in each of the respective chambers, and which is generated by the combustion of fuel therein. The present invention is further characterized in that the aforesaid directions extend in such a manner as to be symmetrically tangential to and equally spaced about imaginary circles, which lie in a horizontal plane and are concentric with the vertical axes of the respective chambers of the dual-chambered furnace volume. The present invention is also further characterized in that the yaw of each of the SOFA nozzles of each of the SOFA windboxes may be controlled so as to direct separated overfire air into the respective chambers of the dual-chambered furnace volume along directions in a manner such that the respective sizes of the imaginary circles may be increased or decreased in order to effect thereby an improvement in the mixing of the separated overfire air with the flue gases. Furthermore, the tilt of each of the SOFA nozzles may be controlled so as to direct the separated overfire air into the respective chambers of the dual-chambered furnace volume at such an angle from the horizontal so as to thereby effect therewith an improvement in the air staging of the staged combustion process.

Due to the likeness and similarity of each of the SOFA windboxes and the geometry and location of the imaginary circles within the respective chambers of the dual-chambered furnace volume, the description of one SOFA windbox is equally applicable to all. To that end, each SOFA windbox is suitably supported at a strategic location along the perimeter of the furnace volume and above the main burner zone of the furnace volume such that the longitudinal axis of the SOFA windbox extends substantially in parallel relation to the vertical axis of the respective chamber of the dual-chambered furnace volume. A plurality of vertically arranged SOFA compartments is provided within the said SOFA windbox. Each of the plurality of SOFA compartments in turn contains a plurality of SOFA nozzles supported in mounted relation therewithin. A separated overfire air supply means is operatively connected to the SOFA nozzles for supplying separated overfire air thereto and thence therethrough to the furnace volume.

In accordance with another aspect of the present invention there is provided a method of injecting separated overfire air into a dual-chambered furnace volume. The subject method includes the steps of providing three separated overfire air windboxes mounted in supported relation within the respective chambers of the dual-chambered furnace volume so as to be above and in offset relation with the plurality of main windboxes and so as to be substantially aligned with the vertical axis of the respective chambers of the dual-chambered furnace volume as well as substantially aligned along the corresponding axes thereof, of providing a plurality of vertically arranged separated overfire air compartments mounted within each of the three separated overfire air windboxes, of providing a plurality of separated overfire air nozzles supported within each of the plurality of separated overfire air compartments operative for directing separated overfire air into the respective chambers of the dual-chambered furnace volume, of providing a separated overfire air supply means connected in fluid communication to each of the separated overfire air nozzles so as to be operative for supplying separated overfire air thereto and thence therethrough to the respective chambers of the dual-chambered furnace volume, of injecting separated overfire air from the separated overfire air nozzle into the respective chambers of the dual-chambered furnace volume so as to be directed along predetermined directions in order so as to thereby effectuate the mixing of the separated overfire air with the flue gases such that the separated overfire air collectively engages, in a co-rotational or counter-rotational fashion, the rotating fireball generated from the combustion of the fuel and air which is symmetrically tangential to and equally spaced about the aforesaid imaginary circles and wherein the mixing of the separated overfire air and the combustion flue gases is measured by a mixing index, of controlling the horizontal movement of each of the SOFA nozzles such that the directions of the separated overfire air can be made to extend in a continuous range of horizontal directions so as to thereby be operative to increase or decrease the size of the aforementioned imaginary circles while yet at the same time maintaining the symmetrical tangency and equal spacing relative to each of the directions of the separated overfire air about the imaginary circles, and of controlling the vertical movement of each of the SOFA nozzles such that the directions of the separated overfire air can be made to extend in a continuous range of vertical directions while yet at the same time maintaining the symmetrical tangency and equal spacing of the directions of the separated overfire air about the imaginary circles.

DESCRIPTION OF THE PREFERRED EMBODIMENT

Figure 1:
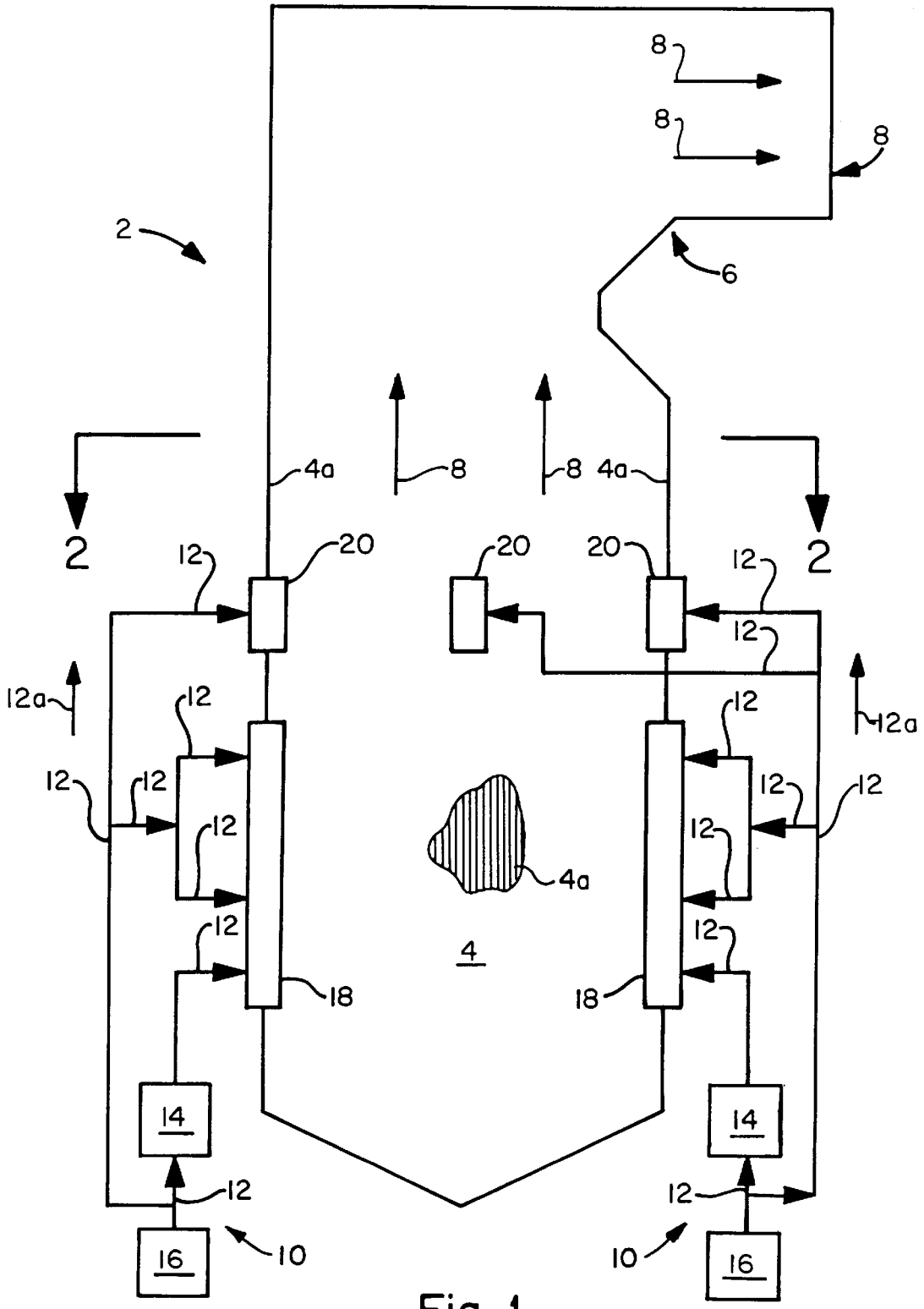
FIG. 1 is a diagrammatic representation in the nature of a vertical sectional view of a fossil fuel-fired steam generating power plant including a furnace volume, a horizontal pass, a fuel and air injection system and illustrated therein as embodying a separated overfire air injection system constructed in accordance with the present invention.

Referring now to FIG. 1 depicted therein is a fossil fuel-fired steam generator 2. As depicted in FIG. 1 the fossil fuel-fired steam generating power plant comprises a furnace volume 4, a horizontal pass 6, and a backpass volume (not shown). Inasmuch as the nature of the construction and the mode of operation of fossil fuel-fired steam generators are well known to those skilled in the art, it is not deemed necessary to set forth a detailed description of the fossil fuel-fired steam generator 2. Rather, for purposes of obtaining an understanding of a fossil fuel-fired steam generator 2, it is deemed sufficient that there be presented herein merely a description of the nature of the components of the fossil fuel-fired steam generator 2 with which a sixpoint overfire air injection system constructed in accordance with the present invention cooperates. For a more detailed description of the nature of the construction and mode of operation of the components of such a fossil fuel-fired steam generator, for instance a pulverized coal burning steam generator, reference may be had to the prior art, e.g., U.S. Pat. No. 4,719,587, which issued Jan. 12, 1988 and which is assigned to the same assignee as the present patent application.

Reference is again had to FIG. 1 and in particular to the furnace volume 4 of the fossil fuel-fired steam generator 2. It is within the furnace volume 4 that, in a manner well known to those skilled in the art, combustion of fuel and air occurs. Hot gases 8 are produced from this combustion. These hot gases 8, generally known as flue gases 8, rise upwardly within the furnace volume 4 and in accordance with a predefined thermodynamic steam cycle give up energy to a working fluid. This working fluid flows through furnace waterwall tubes 4*a* which, in a conventional manner, form the four walls that serve to define therewithin the furnace volume 4. The flue gases 8 then exit the furnace volume 4 through the horizontal pass 6 and are directed to and through the backpass volume (not shown) of the steam generator 2. Both the horizontal pass 6 and the backpass volume (not shown) commonly contain additional heat exchange surfaces (not shown in the interest of maintaining clarity of illustration in the drawing) for generating and superheating steam in a manner well known to those skilled in the art. Thereafter, the steam produced from the energy given up to the working fluid flowing through the furnace waterwall tubes 4*a* commonly is made to flow to a turbine (not shown), which forms one component of a turbine/generator set (not shown). This steam provides the motive power to drive the turbine, which thence drives the generator, which in known fashion is cooperatively associated with the turbine such that electricity is produced from the generator.

Referring further to FIG. 1 there is also depicted therein a schematic representation of a means, generally designated by the reference numeral 10, for supplying fuel and air to the furnace volume 4. The fuel and air supply means 10 includes ductwork 12 so designed and constructed as to transport fuel and air, separately or if need be in combination, from a fuel source 14 and an air source 16 to a main windbox 18 and a separated overfire air (SOFA) windbox 20.

Figure 2:
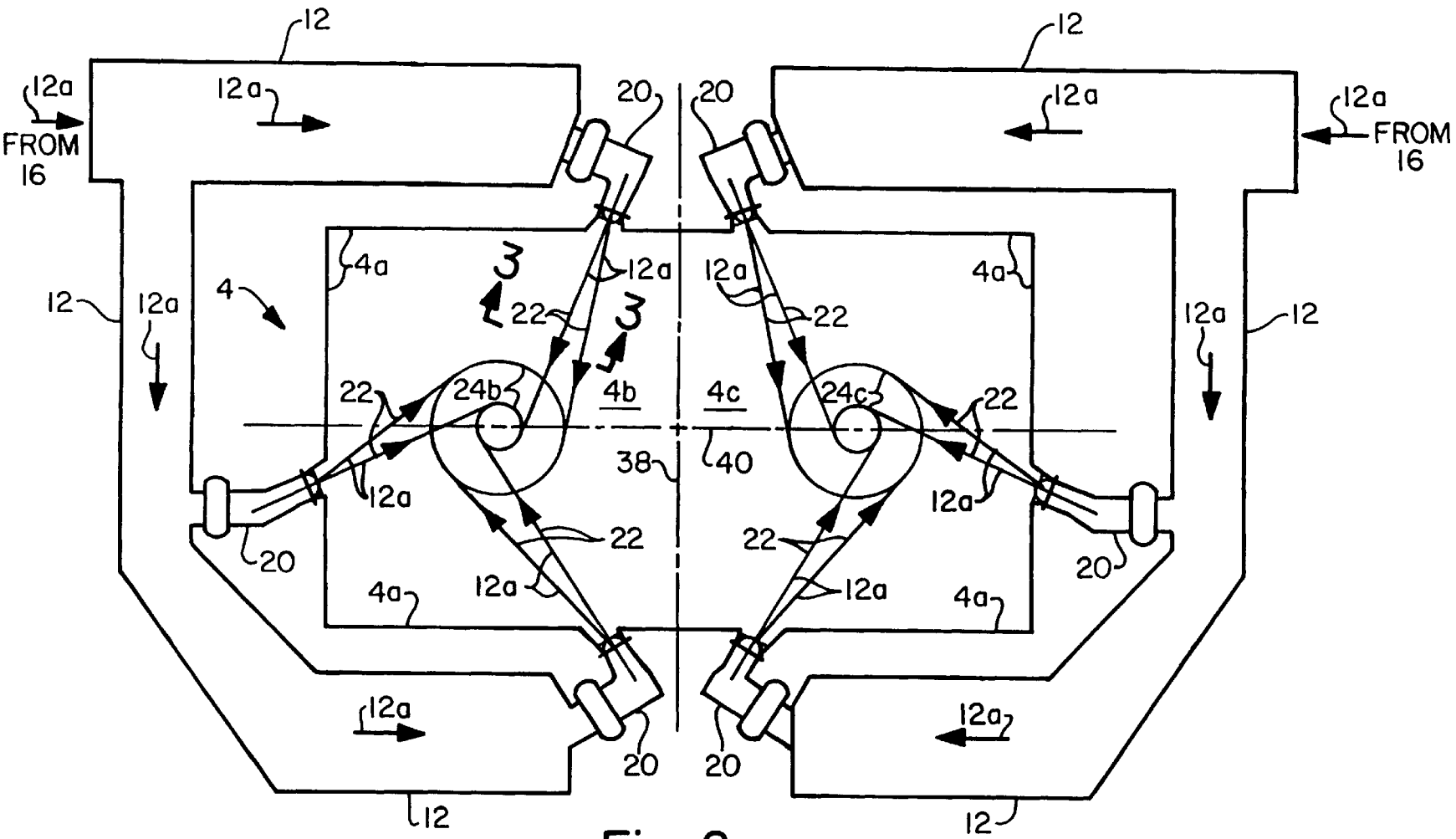
FIG. 2 is a schematic representation of a plan view of the furnace volume of the fossil fuel-fired steam generating power plant of FIG. 1, which as illustrated in FIG. 1 embodies a separated overfire air injection system constructed in accordance with the present invention.

Referring next to FIG. 2, there is depicted therein a schematic diagram of a plan view of the furnace volume 4 of FIG. 1. As depicted therein the furnace volume 4 includes the waterwall tubes 4*a*, ductwork 12 and six SOFA windboxes 20 strategically located about the perimeter of the furnace volume 4. The SOFA windboxes 20 are each suitably supported in a mounted relation through the use of any conventional means (not shown) suitable for use for such a purpose. It can be seen with reference to FIG. 2 that the furnace volume 4 is divided, by a first horizontal axis 38, as viewed with reference to FIG. 2, into a left chamber 4*b* and a right chamber 4*c*. In FIG. 2 it can also be seen therefrom that separated overfire air 12*a* is delivered from the air source 16, via the ductwork 12, to the SOFA windboxes 20 and thence is injected therethrough into the left chamber 4*b* and right chamber 4*c* of the furnace volume 4 in the direction which has been schematically indicated in FIG. 2 by the reference numeral 22.

Figure 3:
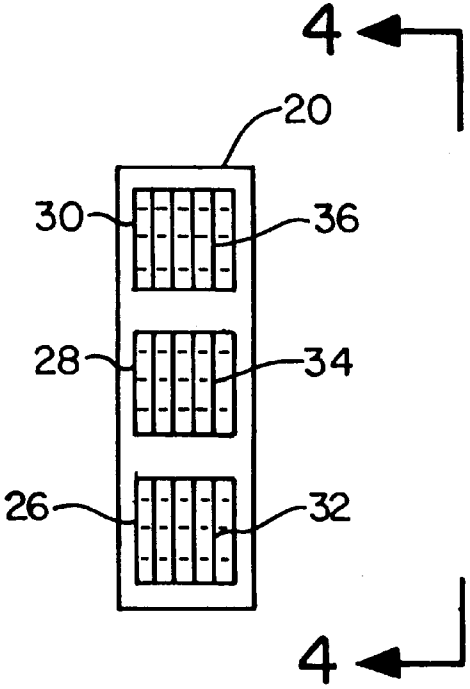
FIG. 3 is a schematic representation in elevation of a sectional view of the separated overfire air windbox of FIG. 2 of the separated overfire air injection system constructed in accordance with the present invention.
Figure 4:
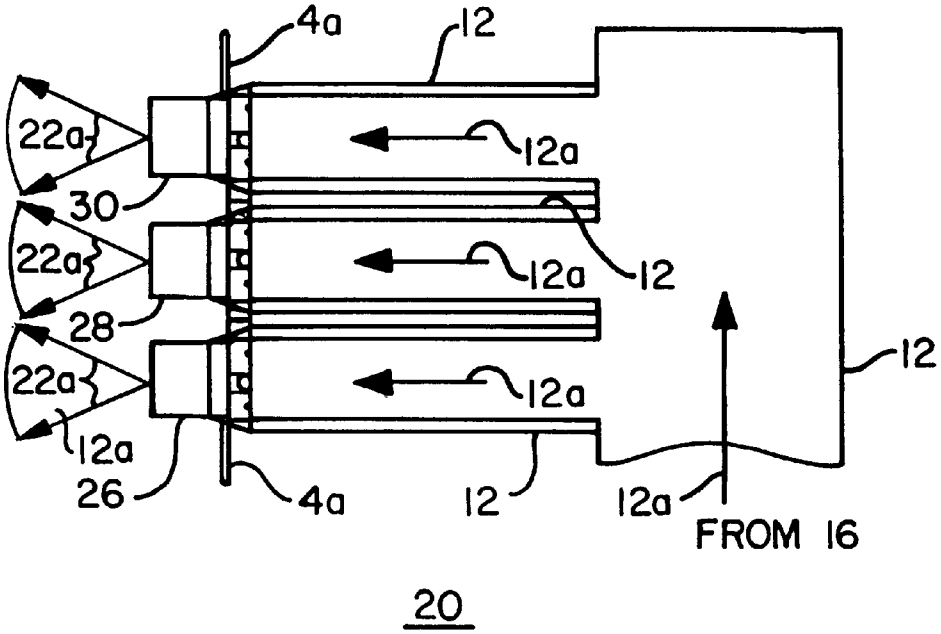
FIG. 4 is a further schematic representation in elevation of a sectional view of the separated overfire air windbox of FIG. 3 of the separated overfire air injection system constructed in accordance with the present invention.

In the interest of providing one with a better understanding with respect to the nature of the SOFA windboxes 20, reference will be had to FIG. 3 and FIG. 4. FIG. 3 is a schematic diagram of a front elevation of the SOFA windboxes 20 of FIG. 2. FIG. 4 is a schematic diagram of the side elevation of the SOFA windboxes 20 depicted in FIG. 3. From FIG. 3 and FIG. 4 it can be seen that the SOFA windboxes 20 include a plurality of vertically arranged SOFA compartments 26, 28, 30. Further, it can be seen from FIG. 3 that a plurality of SOFA nozzles 32, 34, 36 are respectively suitably supported in mounted relation, through the use of any conventional mounting means (not shown) suitable for use for such a purpose, within the plurality of SOFA compartments 26, 28, 30. Each of the SOFA nozzles 32, 34, 36 is so mounted as to be capable of both vertical (tilting) and horizontal (yaw) movement in a corresponding one of the SOFA compartments 26, 28, 30. As best understood with reference to FIG. 4, the plurality of SOFA nozzles 32, 34, 36 are each operatively connected to the air supply means 16, via the ductwork 12. The air supply means 16 is designed so as to be operative to deliver separated overfire air 12*a* to each of the SOFA compartments 26, 28, 30, and more specifically to the SOFA nozzles 32, 34, 36 mounted therein, and thence therethrough to the left chamber 4*b* and right chamber 4*c*, as viewed with reference to FIG. 4, of the furnace volume 4.

Figure 2A:
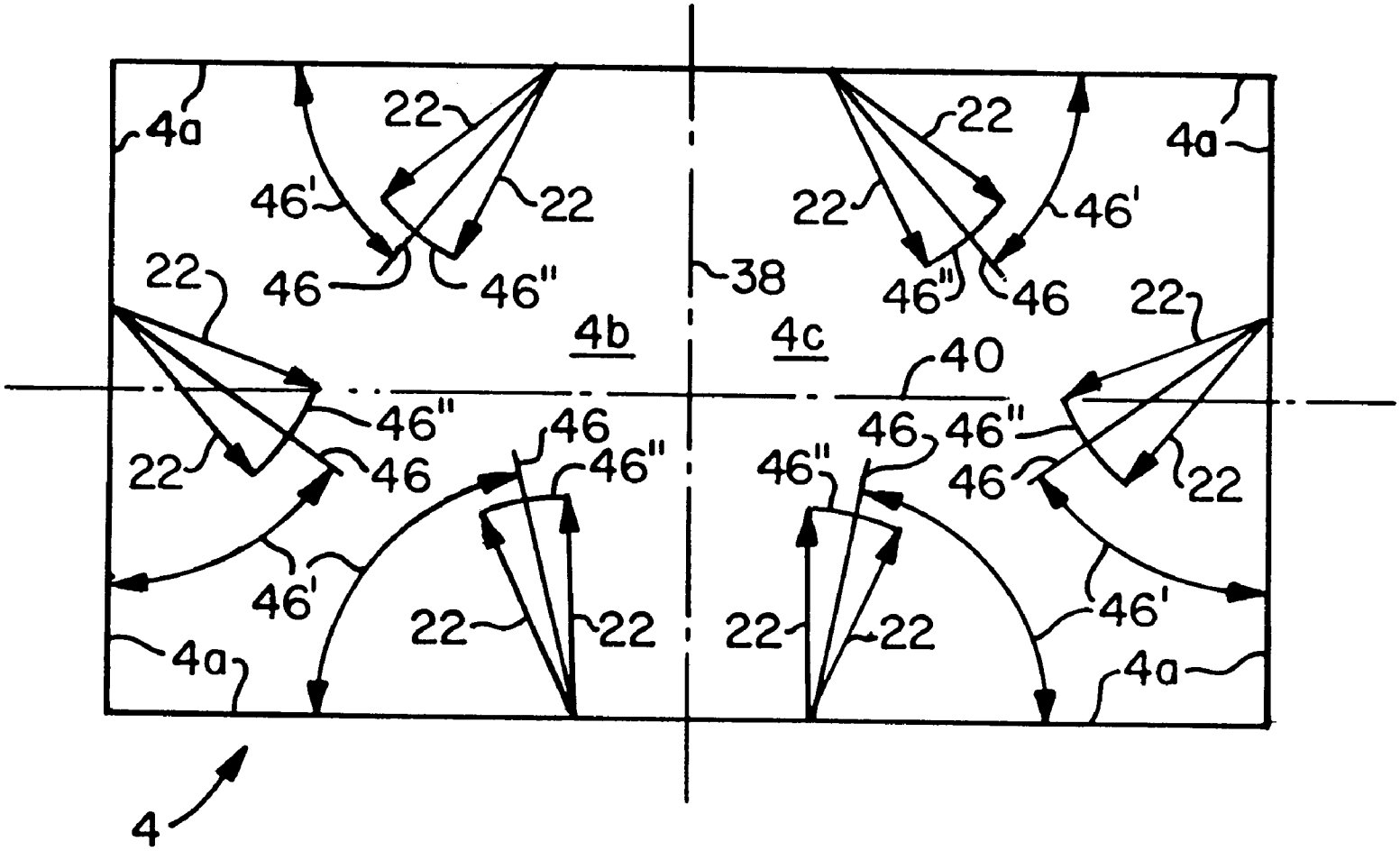
FIG. 2*a* is a more simplified schematic representation of the plan view of the furnace volume of the fossil fuel-fired steam generating power plant of FIG. 2 and in accordance with the illustration therein depicting in a horizontal plane the axes and the angles of the separated overfire injection system constructed in accordance with the present invention.

In the interest of providing one with a better understanding with respect to the orientation of the SOFA windboxes 20 and the vertical and horizontal movement of the SOFA nozzles 32, 34, 36, reference will be had to FIG. 2*a* as well as to FIG. 4. FIG. 2*a* depicts a more simplified schematic diagram of the plan view of the furnace volume 4 which is depicted in FIG. 2. As can be seen from FIG. 2*a* the SOFA windboxes 20 are each oriented so as to be substantially aligned along an axis 46, which in turn subtends an injection angle 46' measured with respect to the waterwalls 4*a* of the furnace volume 4. By the judicious manipulation and control of the aforesaid yaw capabilities of the SOFA nozzles 32, 34, 36, the SOFA nozzles 32, 34, 36 embody the capability of extending at any given time in any particular direction selected from a range of directions 22 lying in a horizontal plane. The limits of the range of these directions 22 subtend an angle denoted by reference numeral 46" in FIG. 2*a*. As noted above, FIG. 4 is a schematic diagram of the side elevation view of the SOFA windbox 20 of FIG. 3 wherein the tilting capabilities of the SOFA nozzles 32, 34, 36 are depicted. It should also be apparent from reference to FIG. 4 that, through the judicious manipulation and control of the forereferenced tilting capabilities of the SOFA nozzles 32, 34, 36, the SOFA nozzles 32, 34, 36 embody the capability of extending at any given time in any particular direction selected from a range of directions 22*a* lying in a vertical plane so as to thereby be operative to provide the necessary air staging of the staged combustion process.

Referring again to FIG. 2, as has been discussed hereinabove, the SOFA windboxes 20 are strategically located about the perimeter of the furnace volume 4 so as to be operative to inject separated overfire air 12*a*, in the direction 22, into the left chamber 4*b* and the right chamber 4*c*, as viewed with reference to FIG. 4, of the furnace volume 4. It is to be further understood with reference to FIG. 2 that by the judicious manipulation and control of the yaw capabilities of the SOFA nozzles 32, 34, 36, separated overfire air 12*a* may be injected from the SOFA compartments 26, 28, 30, in the direction 22, so as to collectively engage, in a co-rotational or counter-rotational fashion, one or the other of two rotating fireballs (not shown in FIG. 2 in the interest of maintaining clarity of illustration therein). One such rotating fireball is located in each of the left chamber 4*b* and the right chamber 4*c*, as viewed with reference to FIG. 4, of the furnace volume 4. These rotating fireballs are generated, as previously herein described, by the combustion of fuel and air in the main burner zone of the respective chambers 4*b*, 4*c* of the furnace volume 4. As best understood with reference to FIG. 2 the separated overfire air 12*a* is injected into the left chamber 4*b* and the right chamber 4*c*, as viewed with reference to FIG. 4, of the furnace volume 4 through the SOFA compartments 26, 28, 30, in the direction 22, so as to thereby be symmetrically tangential to and equally spaced about a first imaginary horizontal circle 24*b* or a second imaginary horizontal circle 24*c*. The imaginary circles 24*b*, 24*c* are normally centered along a second horizontal axis 40, coplanar with and perpendicularly intersecting the first axis 38, and are further situated so as to be centrally located within the left chamber 4*b* or the right chamber 4*c*, as viewed with reference to FIG. 4, of the furnace volume 4, respectively, and so as to be substantially coterminous with the aforedescribed fireballs such that the fireballs rotate in a circumferential manner about the imaginary circles 24*b*, 24*c*. It can further be seen from a reference to FIG. 2 that through the judicious manipulation and control of the yaw capabilities of the SOFA nozzles 32, 34, 36, the respective radii of the imaginary circles 24*b*, 24*c* may also be increased or decreased in order to effect as a result thereof an improvement in the mixing of the separated overfire air 12*a* with the flue gases 8 generated by the aforereferenced combustion.

Figure 5:
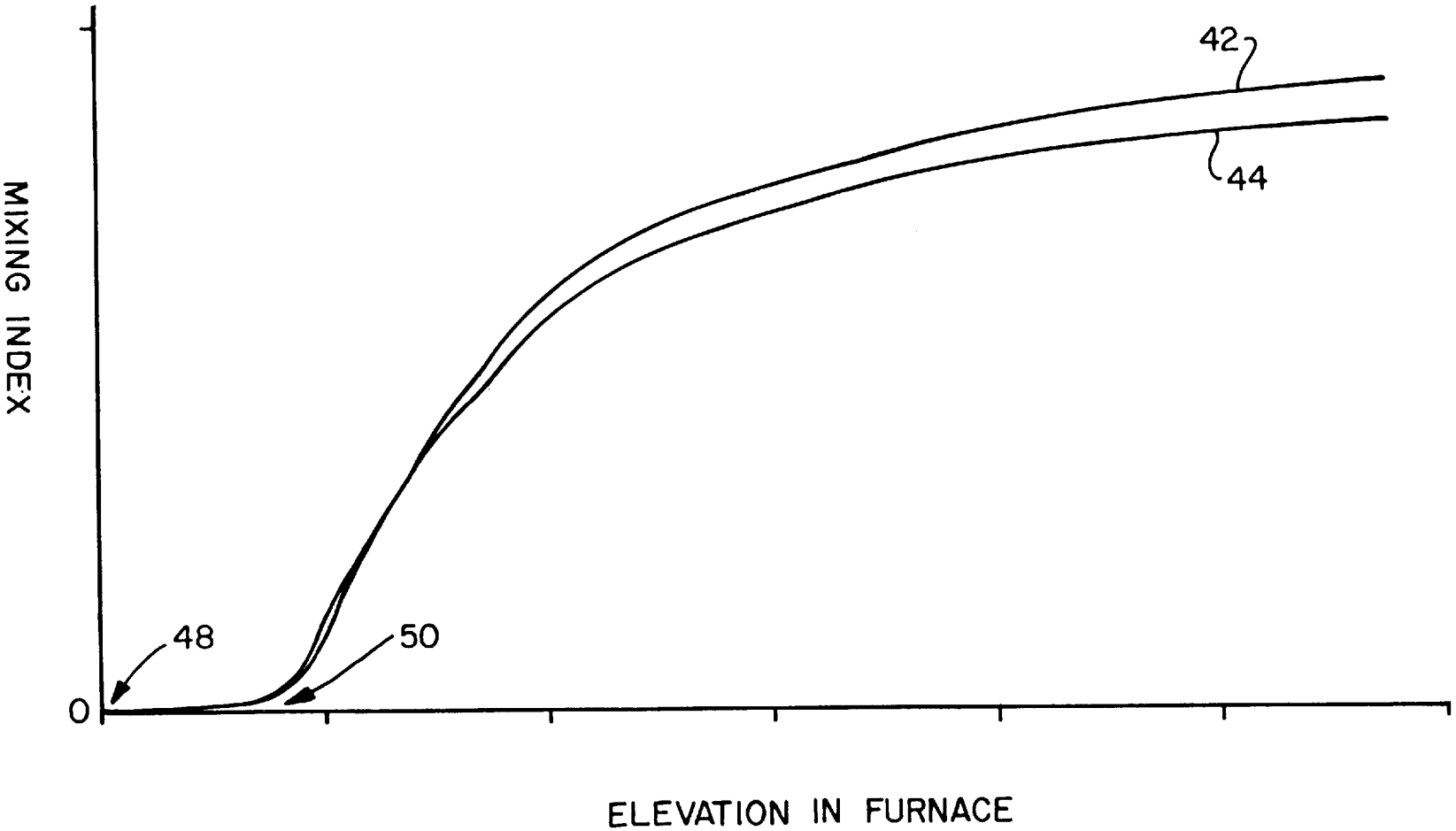
FIG. 5 is a graphical representation of the mixing index plotted as a function of elevation within the furnace depicted through the extent to which mixing of separated overfire air and combustion gases occurs within the furnace volume of the steam generating power plant.

The advantages that accrue from the introduction of separated overfire air 12*a* into a furnace volume 4 via the utilization of strategically located SOFA windboxes, such as the SOFA windboxes 20 of the present invention, are best seen with reference to FIG. 5. As noted, herein previously, FIG. 5 is a graphical depiction of the mixing index plotted as a function of elevation in the furnace and depicting therethrough the extent to which mixing of separated overfire air and combustion gases occurs within a furnace volume such as the furnace volume 4 described herein. The mixing index is a dimensionless ratio which is a measure of the degree to which a gas tracer species, injected through the nozzles of interest, is mixed with the bulk flue gas at a given horizontal plane in a furnace volume, such as the furnace volume 4. The local tracer concentration at each location in the horizontal plane is compared to the fully mixed value of the tracer gas and weighted by the local mass flow rate of flue gases passing through the horizontal plane. When summed over the entire plane, the result is a mixing index that ranges from a value of 0 to 1, where a mixing index of 1 indicates a uniform tracer composition as the tracer species has been completely mixed with the bulk furnace gases. Thus the mixing index can be regarded as an indication of the degree or thoroughness to which separated overfire air mixes with the flue gases generated from the combustion process occurring within the main burner zone of a furnace volume such as the furnace volume 4.

Continuing, with further reference to FIG. 5, the line denoted therein by the reference numeral 42 represents the mixing index when utilizing four SOFA windboxes to inject separated overfire air into a furnace volume such as the dual-chambered furnace volume 4. On the other hand, the line denoted by the reference numeral 44 in FIG. 5 represents the mixing index when utilizing only three SOFA windboxes 20, in accordance with the teachings of the present invention, to inject separated overfire air into a the dual-chambered furnace volume 4. As can be seen with reference to FIG. 5, the mixing indices 42, 44 are approximately zero, and remain essentially so, from a first elevation, denoted in FIG. 5 by the reference numeral 48 that is located approximately just above the main windbox, to a second elevation, denoted in FIG. 5 by the reference numeral 50, that is located approximately just below the SOFA windbox 20. At the second elevation 50, the mixing indices 42, 44 begin to increase and, in an approximately asymptotic fashion, approach a value of 1 as elevation within the furnace volume 4 continues to increase. However, the characteristic of more particular importance seen in FIG. 5 is that the mixing indices 42, 44, when utilizing either four SOFA windboxes, as done heretofore in the prior art, or, as in accordance with the teachings of the present invention, three SOFA windboxes, are substantially equivalent over the elevations in the furnace where mixing of separated overfire air and combustion gases occurs within the furnace volume 4.

It should therefore be readily apparent from the foregoing description that the present invention offers significant advantages in the utilization of the overfire air concept and in particular the manner of introduction of separated overfire air into the respective chambers of a dual-chambered furnace volume, such as the furnace volume 4. More particularly, in accordance with the present invention, there has been provided a new and improved separated overfire air system which is characterized in that through the use thereof the mass flow rate of fuel and the mass flow rate of air delivered to the respective chambers of a dual-chambered furnace volume, such as the furnace volume 4, remain unchanged when retrofitted thereto. Furthermore, in accordance with the present invention, there has been provided a new and improved separated overfire air system which is characterized in that through the use thereof the mass flow rate of output steam remains unchanged when retrofitted in a dual-chambered furnace volume such as the furnace volume 4. In addition, in accordance with the present invention, there has been provided a new and improved separated overfire air system which is characterized in that through the use thereof the ability to maintain fireball stability, shape and position within the respective chambers of a dual-chambered furnace volume is unaffected when retrofitted thereto. Also, in accordance with the present invention, there has been provided a new and improved separated overfire air system which is characterized in that through the use thereof a minimum number of waterwall penetrations and attendant ductwork are required in order to accomplish the retrofit thereof in a dual-chambered furnace volume, such as the furnace volume 4. Again, in accordance with the present invention, there has been provided a new and improved separated overfire air system which is characterized in that through the use thereof it is possible to achieve therewith a reduction in the formation of $NO_X$ during the combustion process that takes place within the respective chambers of a dual-chambered furnace volume such as the furnace volume 4, when retrofitted thereto. Also, in accordance with the present invention, there has been provided a new and improved separated overfire air system which is characterized in that although primarily intended for retrofit applications it may also be used in new applications. Also, in accordance with the present invention, there has been provided a new and improved separated overfire air system which is characterized in that the primary use thereof is for dual-chambered furnace volumes. Furthermore, in accordance with the present invention there has been provided a new and improved separated overfire air system which is characterized in that it is relatively easy to install, relatively simple to operate, yet is relatively inexpensive to provide.

While several embodiments of our invention have been shown or alluded to herein, it will be appreciated that modifications thereto may still be readily made by those skilled in the art. We, therefore, intend by the appended claims to cover all of these modifications as well as to all other modifications, which fall within the true spirit and scope of the invention.

What is claimed is:

1. In a fuel-fired furnace having a plurality of waterwalls embodying therewithin both a first furnace volume having a vertically extending axis and a first imaginary horizontally extending firing circle centrally located therewithin and a second furnace volume having a vertically extending axis and a second imaginary horizontally extending firing circle centrally located therewithin, a plurality of main windboxes supported in mounted relation within the first furnace volume and the second furnace volume of the fuel-fired furnace, means for supplying fuel and air to the plurality of main windboxes and therethrough into the first furnace volume and the second furnace volume, and a firing system operative for effecting in both the first furnace volume and the second furnace volume a partial combustion of the fuel and air supplied thereto such that the flue gases generated from such partial combustion of the fuel and air form both a first rotating fireball in the first furnace volume rotative circumferentially about the first imaginary horizontally extending firing circle centrally located therewithin and a second rotating fireball in the second furnace volume rotative circumferentially about the second imaginary horizontally extending firing circle centrally located therewithin, the improvement of an overfire air system effective for lowering the $NO_X$ emissions from the fuel-fired furnace, said overfire air system comprising:

a. a first set of three overfire air windboxes mounted in spaced relation relative to each other at strategic locations around the perimeter of the first furnace volume of the fuel-fired furnace so as to be located above in offset relation to the plurality of main windboxes such as to face in a direction defined by a predetermined angle measured with respect to the waterwalls of the fuel-fired furnace and so as to be substantially aligned with the vertically extending axis of the first furnace volume;

b. at least one vertically arranged overfire air compartment is supported in mounted relation within each one of said first set of three overfire air windboxes;

c. an overfire air nozzle supported in mounted relation within each of said at least one vertically arranged overfire air compartments in order to be operative for injecting overfire air therefrom into the first furnace volume of the fuel-fired furnace at a predetermined injection angle measured relative to the direction faced by said first set of three overfire air windboxes in order to thereby effect the mixing of the injected overfire air with the flue gases within the first furnace volume in accordance with a mixing index indicative of the thoroughness of the mixing occurring between the injected overfire air and the flue gases within the first furnace volume, said overfire air nozzle of said at least one vertically arranged overfire air compartment of each of said three overfire air windboxes being operable to inject overfire air at an injection angle such that said overfire air nozzles form three points of tangency equally spaced one to another about the first imaginary horizontally extending firing circle centrally located within the first furnace volume; and d. a first over fire air supply means connected in fluid flow relation with said overfire nozzle supported within each of said at least one vertically arranged overfire air compartments so as to be operative to supply overfire air thereto.

2. In a fuel-fired furnace, the improvement of an overfire air system as set forth in claim 1 wherein up to five vertically arranged overfire air compartments are supported in mounted relation within each one of said first set of three overfire air windboxes.

3. In a fuel-fired furnace, the improvement of an overfire air system as set forth in claim 1 wherein more than one overfire air nozzle is supported in mounted relation within each of said at least one vertically arranged overfire air compartments.

4. In a fuel-fired furnace, the improvement of an overfire air system as set forth in claim 1 wherein the direction faced by said first set of three overfire air windboxes is defined by an angle of between 30 degrees and 70 degrees measured with respect to the waterwalls of the fuel-fired furnace.

5. In a fuel-fired furnace, the improvement of an overfire air system as set forth in claim 1 wherein the injection angle of the overfire air is between −15 degrees and +15 degrees.

6. In a fuel-fired furnace, the improvement of an overfire air system as set forth in claim 1 wherein the mixing index is a dimensionless ratio varying with height in the first furnace volume of the local concentration of a gas tracer species injected into the first furnace volume at a prescribed horizontal plane to the fully mixed value of the tracer gas weighted by the local mass flow rate of the flue gases passing through the horizontal plane summed over the horizontal plane.

7. In a fuel-fired furnace, the improvement of an overfire air system as set forth in claim 6 wherein the mixing index is approximately zero and remains essentially zero from a first elevation within the first furnace volume located approximately just above the plurality of main windboxes to a second elevation located approximately just below said first set of overfire air windboxes whereat the mixing index begins to increase and in an approximately asymptotic fashion approaches a value of one as the elevation within the first furnace volume increases.

8. In a fuel-fired furnace, the improvement of an overfire air system as set forth in claim 1 further comprising:

a. a second set of three overfire air windboxes mounted in spaced relation relative to each other at strategic locations around the perimeter of the second furnace volume of the fuel-fired furnace so as to be located above in offset relation to the plurality of windboxes such as to face in a direction defined by a predetermined angle measured with respect to the waterwalls of the fuel-fired furnace and so as to be substantially aligned with the vertically extending axis of the second furnace volume;

b. at least one vertically arranged overfire air compartment supported in mounted relation within each one of said second set of three overfire air windboxes;, c. an overfire air nozzle supported in mounted relation within each of said at least one vertically arranged overfire air compartments in order to be operative for injecting overfire air therefrom into the second furnace volume of the fuel-fired furnace at a predetermined injection angle measured relative to the direction faced by said second set of three overfire air windboxes in order to effect the mixing of the injected overfire air with the flue gases within the second furnace volume in accordance with a mixing index indicative of the thoroughness of the mixing occurring between the injected overfire air and the flue gases within the second furnace volume, said overfire air nozzle of said at least one vertically arranged overfire air compartment of each of said three overfire air windboxes being operable to inject overfire air at an injection angle such that said overfire air nozzles form three points of tangency equally spaced one to another about the first imaginary horizontally extending firing circle centrally located within the first furnace volume; and d. a second overfire air supply means connected in fluid flow relation with said overfire air nozzle supported within each of said at least one vertically arranged overfire air compartments mounted in supported relation within each one of said second set of three overfire air windboxes so as to be operative to supply overfire air thereto.

9. In a fuel-fired furnace, an improvement of an overfire air system as set forth in claim 8 wherein up to five vertically arranged overfire air compartments are supported in mounted relation within each one of said second set of three overfire air windboxes.

10. In a fuel-fired furnace, an improvement of an overfire air system as set forth in claim 8 wherein more than one overfire air nozzle is supported in mounted relation within each of said at least one vertically arranged overfire air compartments supported in mounted relation within each one of said second set of three overfire air windboxes.

11. In a fuel-fired furnace, an improvement of an overfire air system as set forth in claim 8 wherein the direction faced by said second set of three overfire air windboxes is defined by an angle of between 30 degrees and 70 degrees measured with respect to the waterwalls of the furnace.

12. In a fuel-fired furnace, an improvement of an overfire air system as set forth in claim 8 wherein the injection angle of the overfire air is between −5 degrees and +15 degrees.

13. In a fuel-fired furnace, the improvement of an overfire air system as set forth in claim 8 wherein the mixing index is a dimensionless ratio varying with height in the second furnace volume of the local concentration of a gas tracer species injected into the second furnace volume at a prescribed horizontal plane to the fully mixed value of the tracer gas weighted by the local mass flow rate of the flue gases passing through the horizontal plane summed over the horizontal plane.

14. In a fuel-fired furnace, an improvement of an overfire air system as set forth in claim 13 wherein the mixing index is approximately zero and remains essentially zero from a first elevation within the second furnace volume located approximately just below the plurality of main windboxes to a second elevation located approximately just below said second set of three windboxes whereat the mixing index begins to increase and in an approximately asymptotic fashion approaches a value of one as the elevation within the second furnace volume increases.

15. A method of operating a fuel-fired furnace for the purposes of lowering $NO_x$ emissions therefrom, the fuel-fired furnace having a plurality of waterwalls embodying therewithin both a first furnace volume having a vertically extending axis and a first imaginary horizontally extending firing circle centrally located therewithin and a second furnace volume having a vertically extending axis and a second imaginary horizontally extending firing circle centrally located therewithin, a plurality of main windboxes supported in mounted relation within the first furnace volume and the second furnace volume of the fuel-fired furnace, means for supplying fuel and air to the plurality of main windboxes and therethrough into the first furnace volume and the second furnace volume, and a firing system operative for effecting in both the first furnace volume and the second furnace volume a partial combustion of the fuel and air supplied thereto such that the flue gases generated from such partial combustion of the fuel and air form both a first rotating fireball in the first furnace volume rotative circumferentially about the first imaginary horizontally extending firing circle centrally located therewithin and a second rotating fireball in the second furnace volume rotative circumferentially about the second imaginary horizontally extending firing circle centrally located therewithin, said method comprising the steps of:

a. providing a first set of three overfire air windboxes mounted in spaced relation relative to each other at strategic locations around the perimeter of the first furnace volume of the fuel-fired furnace so as to be located above in offset relation to the plurality of main windboxes such as to face in a direction defined by a predetermined angle measured with respect to the waterwalls of the fuel-fired furnace and so as to be substantially aligned with the vertically extending axis of the first furnace volume;

b. providing at least one vertically arranged overfire air compartment supported in mounted relation within each one of said first set of three overfire air windboxes;

c. providing an overfire air nozzle supported in mounted relation within each of said at least one vertically arranged overfire air compartments in order to be operative for injecting overfire air therefrom into the first furnace volume of the fuel-fired furnace at a predetermined injection angle measured relative to the direction faced by the first set of three overfire air windboxes in order to effect the mixing of the injected overfire air with the flue gases within the first furnace volume in accordance with a mixing index indicative of the thoroughness of the mixing occurring between the injected overfire air and the flue gases within the first furnace volume, said overfire air nozzle of said at least one vertically arranged overfire air compartment of each of said three overfire air windboxes being operable to inject overfire air at an injection angle such that said overfire air nozzles form three points of tangency equally spaced one to another about the first imaginary horizontally extending firing circle centrally located within the first furnace volume; and d. providing a first overfire air supply means connected in fluid flow relation with the overfire air nozzle supported within each of the at least one vertically arranged overfire air compartments supported in mounted relation within each one of the first set of overfire air windboxes so as to be operative to supply overfire air thereto.

16. The method of operating a fuel-fired furnace for the purpose of reducing $NO_X$ emissions therefrom as set forth in claim 15 further comprising the steps of:

a. providing a second set of three overfire air windboxes mounted in spaced relation relative to each other at strategic locations around the perimeter of the second furnace volume of the fuel-fired furnace so as to be located above in offset relation to the plurality of main windboxes such as to face in a direction defined by a predetermined angle measured with respect to the waterwalls of the fuel-fired furnace and so as to be substantially aligned with the vertically extending axis of the second furnace volume;

b. providing at least one vertically arranged overfire air compartment supported in mounted relation within each one of the second set of three overfire air windboxes;

c. providing an overfire air nozzle supported in mounted relation within each of the at least one vertically arranged overfire air compartments supported in mounted relation within each one of the second set of three windboxes in order to be operative for injecting overfire air therefrom into the second furnace volume of the fuel-fired furnace at a predetermined injection angle measured relative to the direction faced by the second set of three windboxes in order to effect the mixing of the injected overfire air with the flue gases within the second furnace volume in accordance with a mixing index indicative of the thoroughness of the mixing occurring between the injected overfire air and the flue gases within the second furnace volume; and d. providing a second overfire air supply means connected in fluid flow relation with the overfire air nozzle supported in mounted relation within each of the at least one vertically arranged overfire air compartments supported in mounted relation within each one of the second set of overfire air windboxes so as to be operative to supply overfire air thereto.

17. The method of operating a fuel-fired furnace for the purpose of reducing $NO_X$ emissions therefrom as set forth in claim 16 wherein up to five vertically arranged overfire air supported in mounted relation within each one of the first set of three overfire air windboxes and within each one of the second set of three overfire air windboxes.

18. The method of operating a fuel-fired furnace for the purpose of reducing $NO_X$ emissions therefrom as set forth in claim 16 wherein more than one overfire air nozzle is supported in mounted relation within each of the at least one vertically arranged overfire air compartments supported in mounted relation within each one of the first set of three overfire air windboxes and within each of the at least one vertically arranged overfire air compartments supported in mounted relation within each one of the second set of three overfire air windboxes.

19. The method of operating a fuel-fired furnace for the purpose of reducing $NO_X$ emissions therefrom as set forth in claim 16 wherein both the direction faced by the first set of three overfire air windboxes and the direction faced by the second set of overfire air windboxes is defined by an angle of between 30 degrees and 70 degrees measured with respect to the waterwalls of the fuel-fired furnace.

20. The method of operating a fuel-fired furnace for the purpose of reducing $NO_X$ emissions therefrom as set forth in claim 16 wherein the injection angle of the overfire air is between −15 degrees and +15 degrees.

21. The method of operating a fuel-fired furnace for the purposes of reducing $NO_X$ emissions therefrom as set forth in claim 16 wherein the mixing index is a dimensionless ratio varying with height in the first furnace volume of the local concentration of a gas tracer species injected into the first furnace volume at a prescribed horizontal plane to the fully mixed value of the tracer gas weighted by the local mass flow rate of the flue gases passing through the horizontal plane summed over the horizontal plane.

22. The method of operating a fuel-fired furnace for the purpose of reducing $NO_X$ emissions therefrom as set forth in claim 21 wherein the mixing index is approximately zero and remains essentially zero from a first elevation within the first furnace volume located approximately just above the plurality of main windboxes to a second elevation located approximately just below the first set of three overfire air windboxes whereat the mixing index begins to increase and in an approximately asymptotic fashion approaches a value of one as the elevations in the first furnace volume increases.

23. The method of operating a fuel-fired furnace for the purpose of reducing $NO_X$ emissions therefrom as set forth in claim 21 wherein the mixing index is approximately zero and remains essentially zero from a first elevation within the second furnace volume located approximately just above the plurality of main windboxes to a second elevation located approximately just below the second set of three overfire air windboxes whereat the mixing index begins to increase and in an approximately asymptotic fashion approaches a value of one as the elevations in the second furnace volume increases.

* * * * *